United States Patent [19]

Parker

[11] 4,169,968

[45] Oct. 2, 1979

[54] NOISE PROTECTION CIRCUIT FOR AM STEREO COSINE CORRECTION FACTOR

[75] Inventor: Norman W. Parker, Wheaton, Ill.

[73] Assignee: Motorola, Inc., Schaumburg, Ill.

[21] Appl. No.: 872,984

[22] Filed: Jan. 27, 1978

[51] Int. Cl.[2] ..... H04H 5/00

[52] U.S. Cl. ..... 179/1 GS; 325/346

[58] Field of Search ..... 179/15 BT, 1 GS; 325/36, 346, 477, 60

[56] References Cited

U.S. PATENT DOCUMENTS

| | | | |
|---|---|---|---|
| 3,068,475 | 12/1962 | Avins | 179/15 BT |
| 3,080,453 | 3/1963 | Avins | 179/15 BT |
| 3,534,172 | 10/1970 | Weeda | 179/15 BT |
| 4,018,994 | 4/1977 | Kahn | 179/15 BT |
| 4,037,057 | 7/1977 | Ogita et al. | 179/15 BT |

*Primary Examiner*—Douglas W. Olms
*Attorney, Agent, or Firm*—Margaret Marsh Parker; James W. Gillman

[57] ABSTRACT

The cosine correction factor of a receiver for compatible AM stereo reception is controlled by the amount of high frequency energy present in the demodulated signal. Large amounts of such energy indicate a low signal-to-noise ratio and cosine correction under such conditions is then not desirable. During periods of excessive high frequency energy, a filter circuit output causes a switching circuit to remove the derived cosine correction factor and cause division of the demodulated signal by a factor of one instead.

10 Claims, 2 Drawing Figures

NOISE PROTECTION CIRCUIT FOR AM STEREO COSINE CORRECTION FACTOR

BACKGROUND OF THE INVENTION

The present invention relates to the field of receivers for compatible AM stereo reception and, more particularly, to the prevention of increased signal degradation during periods of low S/N ratio.

In a stereophonic receiver for receiving an AM stereophonic signal of the form (L+R) cos ($\omega_c t+\phi$) where $\phi$ is arc tan [(L−R)/(1+L+R)], a correction factor proportional to cos $\phi$ is employed as a divider in order to restore the original and undistorted L and R signals. The cosine factor may be employed once or twice in various stages of the receiver, depending on the design of the receiver. A complete transmitting and receiving system utilizing the above recited compatible signal is fully described in a co-pending application, Ser. No. 674,703, assigned to the same assignee as is the present invention. This patent may be referred to for further details as to the transmitted signal, its characteristics and advantages. Another co-pending application also assigned to the same assignee is Ser. No. 837,258, pertaining to another stereo receiver utilizing the same signal. The receiver of the latter application will be referred to hereinbelow. As may be seen, the envelope of the signal contains only L+R or monophonic information, and no distortion due to the stereo information is produced in monophonic receivers.

As is known, in a typical received audio signal, very little of the contained energy is representative of the higher sound frequencies representative of information; e.g., the highest fundamental frequency played by a piccolo is only slightly higher than two kHz and higher harmonics of voice, instruments, etc., have little energy. Thus, when relatively high energy high frequencies are present in a demodulated signal, they are practically always due to noise or, in other words, the S/N ratio is very low. When such a noisy signal is processed normally in the cosine correction circuitry of a stereo receiver, division by the cosine correction factor further degrades the already poor signal. It is therefore advisable to reduce or eliminate division by the correction factor during periods of low S/N reception. Such periods may have a duration of as little as a fraction of a modulation cycle.

SUMMARY OF THE INVENTION

It is an object therefore of the present invention to improve the performance of an AM stereo receiver during periods of low S/N ratio.

It is a particular object to provide this improvement by controlling the cosine correction factor in response to noise in the received signal.

These objects and others are provided in an AM receiver for receiving a compatible stereo signal of the form (L+R) cos ($\omega_c t+\phi$) where $\phi$ is arc tan [(L−R)/(1+L+R)] by having the stereo correction factor controlled in response to the spectrum of the received signal. A phase locked loop provides a reference frequency for use in obtaining the proper correction factor. The received signal is limited to remove amplitude variations and multiplied by the reference frequency. The resultant signal is proportional in magnitude to the cosine of the angle $\phi$ but has a spectrum related to the spectrum of the received signal. In accordance with the invention, the resultant signal is filtered through a high pass filter and when the filter output contains large amounts of energy (due to noise in the received signal), a voltage-controlled switch is activated to change the correction factor in order to divide the signal by a factor of one instead of a factor proportional to cos $\phi$.

DETAILED DESCRIPTION OF THE PREFERRED EMBODIMENT

Figures 1, 2:
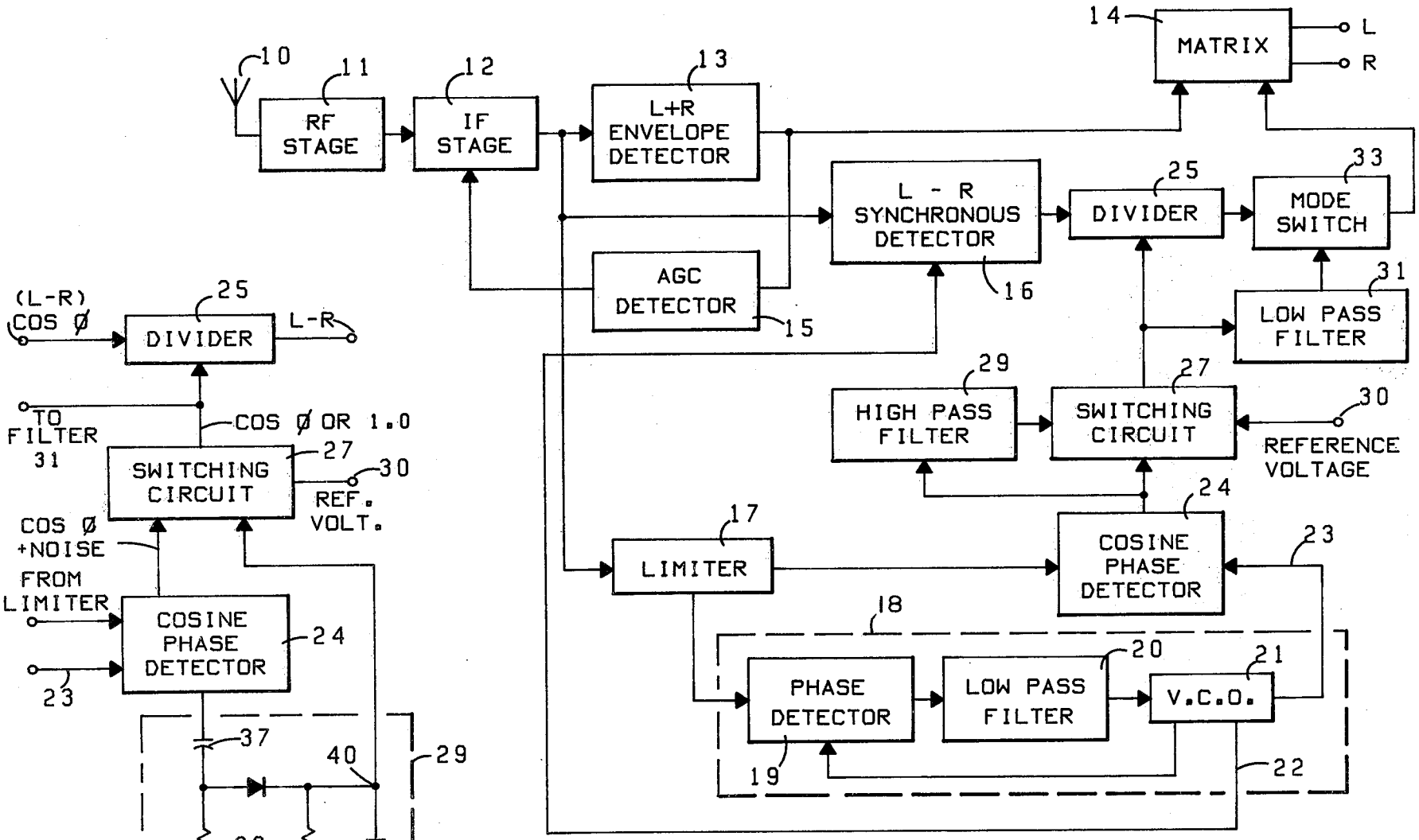
FIG. 1 is a block diagram of an AM stereo receiver incorporating the invention.
FIG. 2 is a partial schematic of a preferred embodiment of the invention.

The present invention is shown in FIG. 1 in a stereo receiver similar to one shown in the co-pending patent application Ser. No. 837,258 but is not limited thereto. This invention is, in fact, applicable to any receiver for receiving compatible AM stereophonic transmission and utilizing a cosine correction factor. A compatible AM stereo signal as described above is received by an antenna 10 and processed in a customary fashion in an RF stage 11 and an IF stage 12. The output of the IF stage 12 is demodulated in an envelope detector 13 to provide the sum signal (L+R). It will be appreciated that other types of demodulators could provide the sum signal as well. It will also be appreciated that the terms "sum" and "difference" or "L" and "R" as used herein are only exemplary of any pair of signals which might have been transmitted in quadrature. The sum signal and the difference signal (L−R) as derived hereinafter are processed in a matrixing circuit 14 to provide the original L and R signals. An AGC detector 15 is coupled to the IF stage 12 to provide automatic gain control for the receiver.

The IF stage 12 is also coupled to a synchronous detector 16 and a limiter 17. The limiter output signal contains only the phase information of the received signal plus, possibly, external noise, and this signal is coupled to a phase locked loop 18 including a phase detector 19, a low pass filter 20 and a VCO 21. A sin $\omega_c t$ output 22 of the VCO 21 is coupled to the synchronous detector 16 where the multiplication process (1+L+R) cos ($\omega_c t+\phi$) (sin $\omega_c t$) produces an output signal (L−R) sin $\phi$ (disregarding the double frequency term). A second output signal 23 from the VCO 21 of the PLL 18 which is cos $\omega_c t$ is coupled to a cosine phase detector 24 as is the output signal from the limiter 17. The instantaneous phase difference $\phi$ between the two carrier frequencies (unmodulated and as transmitted) thus provides the cos $\phi$ information needed to correct the output of the synchronous detector 16 which is (L−R cos $\phi$). In other words, when the (L−R) cos $\phi$ signal is divided by cos $\phi$ in divider 25, the difference signal (L−R) is provided and it is this signal which is normally coupled to the matrix 14.

The receiver as described thus far is a workable one and is completely satisfactory in the presence of a strong received signal; i.e., a signal having a satisfactory S/N ratio. However, when the S/N ratio of the received signal is relatively low, the apparent cos $\phi$ correction factor may be due primarily to noise and when the (L−R) cos $\phi$ signal is divided by this invalid correction factor, distortion in the signal is increased rather than decreased or eliminated. In accordance with the invention, therefore, the output of the phase detector 24, instead of being directly coupled to the divider 25, is coupled to the divider 25 through a switching circuit 27. The output of the cosine phase detector 23 is also coupled to a high pass filter 29, an output of the high pass filter 29 being coupled to a first control input of the switching circuit 27. A second control input 30 provides a reference signal. The switching circuit 27 functions to couple the cosine correction factor from the cosine phase detector 23 directly to the divider 25 as long as the received signal is an acceptable one; i.e. has an acceptable S/N ratio. When the S/N ratio of the received signal is low and the output of the limiter 17 thus contains large amounts of high frequency energy, the high pass filter 29 will provide to the switching circuit 27 a control voltage sufficient to disconnect the output of the cosine phase detector 24 from the divider 25 and to substitute therefor the reference voltage from the terminal 30. This reference voltage is such as to cause the divider 25 to effectively divide the (L−R) cos $\phi$ signal from the synchronous detector 16 by a factor of one.

As described in the co-pending application Ser. No. 837,258, the cosine phase detector 24 output may also be coupled to a low pass filter 31 (2–10 Hz cut-off) where the average DC level of the output can be used to control a mono/stereo mode switch 33. The mode switch 33 is a voltage controlled switch and is set to remain in the "monophonic" position until the PLL locks in on $\omega_c t$, then it switches to the "stereophonic" position.

FIG. 2 includes a portion of FIG. 1 with one embodiment of the high pass filter 29. A capacitor 37 and a resistor 38 make up a high pass filter, per se; i.e., 3 db down at 3 KHz. The D.C. level of the signal appearing at a point 40 (from a diode 41) is therefore a function of the amount of high frequency energy (noise) present in the received signal. When the signal at the point 40 exceeds a predetermined threshold level, the switching circuit 27 prevents the correction factor signal from the cosine phase detector 24 (cos $\phi$+noise) from reaching the divider 25 and provides instead a signal equal to one, i.e., a signal which will cause the divider 25 to divide the (L−R) cos $\phi$ signal by a factor of one. While the preferred embodiment has been disclosed hereinabove and in the drawing, it will be recognized by those skilled in the art that a suitable input for the high pass filter 29 could also be derived from the output of any detector circuit in the receiver. It should be noted that where "periods of excessive high frequency energy" are referred to hereinabove, these periods may be as short as a small fraction of a modulation cycle or could extend over many cycles.

Thus there has been disclosed a means of preventing the further degradation of a noisy signal due to noise-caused error in the cosine correction factor. Other modifications and variations thereof are possible and it is intended to cover all such as fall within the spirit and scope of the appended claims.

What is claimed is:

1. An AM receiver for receiving signals of the form (L+R) cos ($\omega_c t+\phi$) where L and R are information signals, $\omega_c t$ is the carrier frequency and $\phi$ is arc tan {(L−R)/(1+L+R)} and comprising in combination:

input means for selectively receiving, amplifying and providing an output signal in response to the received signal;

demodulator means coupled to the input means for demodulating the responsive signal;

corrector means coupled to the demodulator means for providing an output signal proportional to the cosine of the angle $\phi$;

circuit means for providing a signal which is related in amplitude to the high frequency energy content of the corrector means output signal;

a source of reference signal;

divider means coupled to receive an output signal from the demodulator means; and switching means coupled to receive the reference signal and the corrector means output signal and to selectively couple one of said signals to the divider means in response to the level of the output signal of the circuit means, the divider means dividing the output signal from the demodulator means by the selected signal from the switching means.

2. An AM receiver in accordance with claim 1 and wherein the input means includes antenna means, RF circuitry and IF circuitry.

3. An AM receiver in accordance with claim 1 and wherein the demodulator means comprises a synchronous detector.

4. An AM receiver in accordance with claim 3 and wherein the output signal of the synchronous detector is proportional to (L−R) cos $\phi$.

5. An AM receiver in accordance with claim 4 and further including second demodulator means for providing a signal proportional to (L+R) and matrixing means for receiving the output signals of the second demodulator means and the divider means and deriving therefrom the L and R signals.

6. An AM receiver in accordance with claim 1 and wherein the corrector means comprises limiter means, phase locked loop means coupled to the limiter means, cosine phase detector means coupled to the outputs of the limiter means and the phase locked loop means.

7. An AM receiver in accordance with claim 1 and wherein the signal providing circuit means comprises a high pass filter.

8. An AM receiver in accordance with claim 7 and wherein the high pass filter is down substantially 3 db at 4 KHz.

9. An AM receiver in accordance with claim 1 and wherein the switching means couples the correction signal to the divider means when the output signal of the signal providing circuit means exceeds a predetermined level.

10. A method of demodulating a signal of the form (1+L+R) cos ($\omega_c t+\phi$) for providing output signals proportional to L and R where L and R are intelligence signals, $\omega_c t$ is the carrier frequency and $\phi$ is arc tan {(L−R)/(1+L+R)}, and comprising the steps of:

receiving said signal;

demodulating said received signal to provide a signal proportional to (L+R);

demodulating said received signal to provide a signal proportional to (L−R) cos $\phi$;

detecting the phase modulation on said received signal to provide a signal proportional to cosine $\phi$;

filtering the signal proportional to cosine $\phi$ to provide an output proportional in amplitude to the high frequency energy contained in the signal proportional to cosine $\phi$;

providing a reference signal;

dividing the signal proportional to (L−R) cos $\phi$ by the signal indicative of the high frequency energy, when said indicative signal is lower than a predetermined threshold level, and dividing the signal proportional to (L−R) cos $\phi$ by the reference signal when said indicative signal is greater than the predetermined threshold signal; and matrixing the signal proportional to (L+R) and the (L−R) cos $\phi$ signal after said division to provide output signals proportional to L and R.

* * * * *